United States Patent [19]

Richeson et al.

[11] Patent Number: 4,915,015

[45] Date of Patent: Apr. 10, 1990

[54] PNEUMATIC ACTUATOR

[75] Inventors: William E. Richeson; Frederick L. Erickson, both of Fort Wayne, Ind.

[73] Assignee: Magnavox Government and Industrial Electronics Company, Fort Wayne, Ind.

[21] Appl. No.: 294,727

[22] Filed: Jan. 6, 1989

[51] Int. Cl.[4] ..... F01L 9/00; F15B 13/044

[52] U.S. Cl. ..... 91/459; 91/465; 92/85 B; 251/63.5; 137/625.64; 123/90.14

[58] Field of Search ..... 123/90.11, 90.12, 90.14, 123/90.24; 137/625.64, 625.6; 91/459, 465; 92/85 B; 251/129.05, 129.21, 63.5

[56] References Cited

U.S. PATENT DOCUMENTS

| | | | |
|---|---|---|---|
| 4,582,082 | 4/1986 | Tosseghini | 251/63.5 |
| 4,741,364 | 5/1988 | Stoss et al. | 137/625.6 |
| 4,742,989 | 5/1988 | Akagi | 251/129.05 |
| 4,777,915 | 10/1988 | Bonvallet | 123/90.11 |
| 4,809,587 | 3/1989 | Kawahara et al. | 91/465 |

FOREIGN PATENT DOCUMENTS

| | | | |
|---|---|---|---|
| 197808 | 8/1978 | Fed. Rep. of Germany | 123/90.14 |

*Primary Examiner*—David A. Okonsky
*Assistant Examiner*—Weilun Lo
*Attorney, Agent, or Firm*—Roger M. Rickert; Thomas A. Briody; Richard T. Seeger

[57] ABSTRACT

A pneumatically powered valve actuator is disclosed and includes a valve actuator housing, a working cylinder within the housing having a pair of opposed contoured end faces, and a main piston reciprocable within the cylinder along an axis. The main piston has a pair of oppositely facing primary working surfaces contoured substantially the same as the opposed end faces of the working cylinder to mate therewith providing a small minimum volume and, therefor, a high compression ratio. A pair of air control valves are reciprocable along the axis relative to both the housing and the main piston between open and closed positions for selectively supplying high pressure air to the piston primary working surfaces. The contoured end faces each include a central opening, an outer annular flat surface, and an intermediate frustoconical surface connecting the central opening and the flat surface. A piston motion damping arrangement is operable subsequent to initial piston movement and responsive to continued piston motion for compressing a trapped volume of air thereby slowing piston movement and an array of reed valves return some of the trapped air which has been compressed to a pressure greater than the pressure of the high pressure source to the high pressure source. The reed valves are adjustable to selectively control the quantity of trapped air which is returned to the high pressure source.

16 Claims, 7 Drawing Sheets

PNEUMATIC ACTUATOR

SUMMARY OF THE INVENTION

The present invention relates generally to a two position, straight line motion actuator and more particularly to a fast acting actuator which utilizes pneumatic energy against a piston to perform fast transit times between the two positions. The invention utilizes a pair of control valves to gate high pressure air to the piston and permanent magnets to hold the control valves in their closed positions until a coil is energized to neutralize the permanent magnet latching force and open one of the valves. Stored pneumatic gases accelerate the piston rapidly from one position to the other position. Movement of the piston from one position to the other traps some air adjacent the face of the working piston opposite the face to which accelerating air pressure is being applied creating an opposing force on the piston to slow the piston as it nears the end of its travel. Trapped air at a pressure exceeding the pressure of the source is returned to the source by adjustable reed valves to retrieve a portion of the kinetic energy of the piston. An additional damping of piston motion and retrieval of portion of the kinetic energy of the piston is accomplished by an auxiliary piston which moves with the main or working piston and compresses air to help reclose the control valve.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized With the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

For example, in U.S. Pat.' Application Ser. No. 226,418 entitled VEHICLE MANAGEMENT COMPUTER filed in the name of William E. Richeson on July 29, 1988 there is disclosed a computer control system which receives a plurality of engine operation sensor inputs and in turn controls a plurality of engine operating parameters including ignition timing and the time in each cycle of the opening and closing of the intake and exhaust valves among others. U.S. Pat. No. 4,009,695 discloses hydraulically actuated valves in turn controlled by spool valves which are themselves controlled by a dashboard computer which monitors a number of engine operating parameters. This patent references many advantages which could oe achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

In copending application Ser. No. 021,195, now U.S. Pat. No. 4,794,890, entitled ELECTROMAGNETIC VALVE ACTUATOR, filed Mar. 3, 1987 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, now U.S. Pat. No. 4,878,464, entitled PNEUMATIC ELECTRONIC VALVE ACTUATOR, filed Feb. 8, 1988 in the names of William E. Richeson and Frederick L. Erickson and assigned to the assignee of the present application there is disclosed a somewhat similar valve actuating device which employs a release type mechanism rather than a repulsion scheme as in the previously identified copending application. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not. This copending application also discloses different operating modes including delayed intake valve closure and a six stroke cycle mode of operation.

In copending application Ser. No. 153,155 filed Feb. 8, 1988 in the names of William E Richeson and Frederick L. Erickson, assigned to the assignee of the present application and entitled PNEUMATICALLY POWERED VALVE ACTUATOR there is disclosed a valve actuating device generally similar in overall operation to the present invention. One feature of this application is that control valves and latching plates have been separated from the primary working piston to provide both lower latching forces and reduced mass resulting in faster operating speeds. This concept is incorporated in the present invention and it is one object of the present invention to further improve these two aspects of operation.

Copending applications Ser. Nos. 209,273, now U.S. Pat. No. 4,873,948, and 209,279, now U.S. Pat. No. 4,852,528, entitled respectively PNEUMATIC ACTUATOR WITH SOLENOID OPERATED CONTROL VALVES and PNEUMATIC ACTUATOR WITH PERMANENT MAGNET CONTROL VALVE LATCHING, filed in the names of William E. Richeson and Frederick L. Erickson, assigned to the assignee of the present invention and both filed on June 20, 1988 address, among other things, the use of air pressure at or below source pressure to aid in closing and maintaining closed the control valves along with a reed valve arrangement for recapturing some of the piston motion damping air when that air is compressed to a pressure exceeding source pressure as well as other improvements in operating efficiency over the above noted devices.

Other related applications all assigned to the assignee of the present invention and filed in the name of William E. Richeson on Feb. 8, 1988 are Ser. No. 07/153,262, now U.S. Pat. No. 4,883,025, entitled POTENTIAL-MAGNETIC ENERGY DRIVEN VALVE MECHANISM Where energy is stored from one valve motion to power the next and where a portion of the motive force for the device comes from the magnetic attraction from a latch opposite the one being currently neutralized as in the above noted Ser. No. 153,257; and Ser. No. 07/153,154, now U.S. Pat. No. 4,831,973, entitled REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one position to the other.

In Applicants' assignee docket F-903, now U.S. Pat. No. 4,875,441, filed in the names of Richeson and Erickson, the inventors herein, on even date herewith and entitled ENHANCED EFFICIENCY VALVE ACTUATOR, there is disclosed a pneumatically powered valve actuator which has a pair of air control valves with permanent magnet latching of those control valves in closed position. The magnetic latching force (and therefor, the size/cost) of the latching magnets is reduced by equalizing air pressure on the control valve which heretofor had to be overcome by the magnetic attraction. Damping requirements for the main reciprocating piston are reduced because there is a recapture and use of the kinetic energy of the main piston to reclose the control valve. The main piston shaft has 0-ring sealed "bumpers" at each end to drive te air control valve closed should it fail to close otherwise.

In Applicants' assignee docket F-904, now U.S. Pat. No. 4,872,425, filed in the names of Richeson and Erickson on even date herewith and entitled AIR POWERED VALVE ACTUATOR, the reciprocating piston of a pneumatically driven valve actuator has several air passing holes extending in its direction of reciprocation to equalize the air pressure at the opposite ends of the piston. The piston also has an undercut which, at the appropriate time, passes high pressure air to the back side of the air control valve thereby using air being vented from the main piston of the valve to aid in closing the control valve. The result is a higher air pressure closing the control valve than the air pressure used to open the control valve.

In Applicants' assignee docket F-906, application Ser. No. 295,177, filed in the names of Richeson and Erickson on even date herewith and entitled FAST ACTING VALVE there is disclosed a valve actuating mechanism having a pair of auxiliary pistons which aid in reclosing air control valves while at the same time damping main piston motion near the end of the mechanism travel. Excess damping air or "blow down" is vented through an auxiliary chamber and then through a small radial slot to a collector manifold and thence to the outside of the actuator and returned to the inlet of an air pump to be recompressed and recirculated. Such a radial low pressure air outlet path is common to many of these copending applications.

In Applicant's assignee docket F-910, application Ser. No. 294,729, filed in the name of William E. Richeson on even date herewith and entitled ELECTRO-PNEUMATIC ACTUATOR, an actuator which reduces the air demand on the high pressure air source by recovering as much as possible of the air which is compressed during damping. The main piston provides a portion of the magnetic circuit which holds the air control valves closed. When a control valve is opened, the control valve and the main piston both move and the reluctance of the magnetic circuit increases dramatically and the magnetic force on the control valve is correspondingly reduced.

In Applicants' assignee docket F-911, application Ser. No. 295,178, filed in the names of Richeson and Erickson on even date herewith and entitled COMPACT VALVE ACTUATOR, the valve actuator cover provides a simplified air return path for low pressure air and a variety of new air venting paths allow use of much larger high pressure air accumulators close to the working piston.

All of the above noted cases filed on even date herewith have a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by an electrical pulse in a coil near the permanent magnet. All of the cases employ "windows" which are cupped out or undercut regions on the order of 0.1 inches in depth along a somewhat enlarged portion of the shaft of the main piston, for passing air from one region or chamber to another or to a low pressure air outlet. These cases may also employ a slot centrally located within the piston cylinder for supplying an intermediate latching air pressure as in the above noted Ser. No. 153,155 and a reed valve arrangement for returning air compressed during piston damping to the high pressure air source as in the above noted Ser. No. 209,279. These cases could, as an alternative, employ the reed valve arrangement of the present application. For convenience of explanation, these cases refer to venting or "blow down" to atmosphere and while such venting could be into the ambient atmosphere, the language is intended to encompass venting to a substantially atmospheric pressure outlet with the air to be recirculated to a pump and repressurized in a closed system to avoid the introduction of dust and moisture which might otherwise be ingested with a fresh air inlet.

The entire disclosures of all of the above identified copending applications are specifically incorporated herein by reference.

In the present application, an actuator has one-way pressure relief valves similar to, but improved over, the relief valves in the abovementioned Ser. No. 209,279 to vent captured air back to the high pressure source. The actuator also has "windows" or venting valve undercuts in the main piston shaft which are of reduced size as compared to the windows in other of the cases filed on even date herewith resulting in a higher compression ratio. The actuator of this application increases the area which is pressurized when the air control valve closes thereby still further reducing the magnetic force required.

Among the several objects of the present invention may be noted the provision of a bistable fluid powered actuating device characterized by fast transition times and improved efficiency; the provision of a high compression ratio reciprocating piston actuating device; the provision of a pneumatically driven actuating device having more rapidly reacting control valves; the provision of a pneumatically driven actuating device in accordance with the previous object wherein the control valve reclosure structure does not require any prepressurization from the high pressure air source; the provision of an electronically controlled pneumatically powered valve actuating device having auxiliary pistons which aid both damping and reclosure of control valves; the provision of a valve actuating device having air supply control valves and air chambers which retain and compress air during the time the control valves are opening which compressed air acts to aid reclosing of the air control valves; and the provision of a valve actuating device having an adjustable high pressure air recapture feature. These as well as other objects and advantageous features of the present invention will be in part apparent and in part pointed out hereinafter.

In general, a pneumatically powered valve actuator has a valve actuator housing and a piston reciprocable within the housing along an axis. The piston has a pair of oppositely facing primary working surfaces. A pressurized high pressure air source, an intermediate pressure air pressure source, and a low pressure air outlet are formed as chambers in the housing with appropriate external connections. A pair of air control valves are reciprocable along the axis relative to both the housing and the piston between open and closed positions. A coil is energized to selectively open one of said air control valves to supply pressurized air from the air source to one of said primary working surfaces causing the piston to move. A damping arrangement is operable subsequent to initial piston movement and responsive to continued piston motion for compressing a trapped volume of air thereby slowing piston movement and some of the trapped air which has been compressed to a pressure greater than the pressure of the high pressure source is returned to the high pressure source. The quantity of trapped air which is returned to the high pressure source is selectively controlled by one or more adjustable gap one-way reed valves.

Also in general and in one form of the invention, a bistable electro-pneumatic transducer has a housing with a main piston reciprocable therein along an axis. The main piston has a pair of oppositely facing primary working surfaces and a pair of air control valves reciprocable along the axis relative to both the housing and the main piston between open and closed positions. A coil is energizable to selectively open one of the air control valves to supply pressurized air from the constant pressure air source to one of the piston primary working surfaces causing the main piston to move. A pair of auxiliary pistons are fixed to and movable with the main piston with each auxiliary piston forming, in conjunction with a surface of the corresponding air control valve, a variable volume annular chamber which is responsive to the motion of the corresponding auxiliary piston to urge the one air control valve toward its closed position. Should air pressure from the variable volume chamber fail to reclose the air control valve, a resilient bumper on the auxiliary piston engages and drives the air control valve to its closed position. The pressure within the variable volume annular chamber associated with the opened air control valve will typically be initially at atmospheric pressure and increase throughout a portion of time during which the main piston moves dropping back to atmospheric pressure when the control valve recloses independent of the position of the piston.

BRIEF DESCRIPTION OF THE DRAWING

FIG. 1*b* is an enlarged view of a portion of the housing of FIG. 1 including an illustrative reed valve.

Corresponding reference characters indicate corresponding parts throughout the several views of the drawing.

Figure 1:
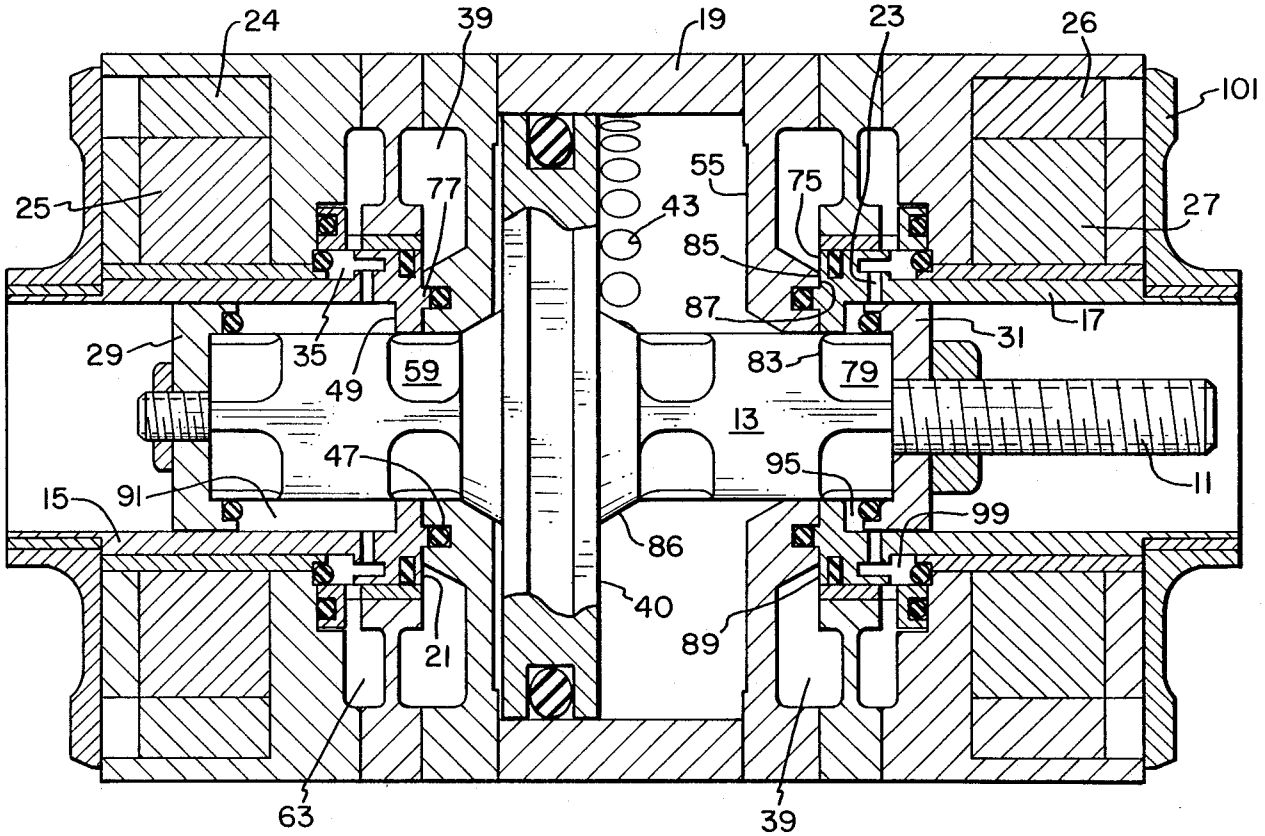
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–7 to illustrate various component locations and functions in moving a poppet valve or other component (not shown) from a closed to an open position. Motion in the opposite direction will be clearly understood from the symmetry of the components. Generally speaking, a pneumatically powered valve actuator is shown having a valve actuator housing 19 and a piston 13 reciprocable within the housing along the axis of the shaft or stem 11. The piston 13 has a pair of oppositely facing primary working surfaces 38 and 40, a pressurized air source 39, a pair of air control valves 15 and 17 reciprocable along the axis relative to both the housing 19 and the piston 13 between open and closed positions. A magnetic neutralization coil 24 or 26 may be energized to neutralize the latching effect of a permanent magnet 25 or 27 for selectively opening one of the air control valves 15 or 17 to supply pressurized air from the air source to one of said primary working surfaces causing the piston to move.

The actuator includes a shaft or stem 11 which may form a part of or connect to an internal combustion engine poppet valve. The actuator also includes a reciprocable piston 13, and a pair of reciprocating or sliding control valve members 15 and 17 enclosed within the housing 19. The control valve members 15 and 17 are latched in a closed position by a combination of the attractive forces of magnets 25 and 27, and may be dislodged from their respective latched positions by energization of coils 24 and 26. The control valve members or shuttle valves 15 and 17 cooperate with both the piston 13 and the housing 19 to achieve various porting functions during operation. The housing 19 has a high pressure inlet port 39 similar to the inlet ports of many of the above identified copending applications. The low pressure may be about atmospheric pressure while the high pressure is on the order of 90–100 psi, gauge pressure. An intermediate or latching air pressure source may, as in earlier applications, supply air at, for example, about 9–10 psi to the annular slot 43.

FIGS. 1 shows an initial state with piston 13 in the extreme leftward position and with the air control valve 15 latched closed. In this state, the annular abutment end surface 77 is inserted into an annular slot in the housing 19 and seals against an "0"-ring 47. This seals the pressure in cavity 39 and prevents the application of any moving force to the main piston 13. In this position, the main piston 13 is being urged to the left (latched) by the pressure on working surface 40. FIG. 1 illustrates the actuator with the power piston 13 latched in the far leftmost position as it would be when the corresponding engine valve is closed. The subpiston annular chamber 91 communicates with the low pressure outlet chamber 63 and is at atmospheric pressure when the main piston is at rest as shown. The subpiston 29 or 31 slidingly engages the inside bore of the air control valve 15. Permanent magnet 25 holds air control valve 15 in a closed state.

Figure 1A:
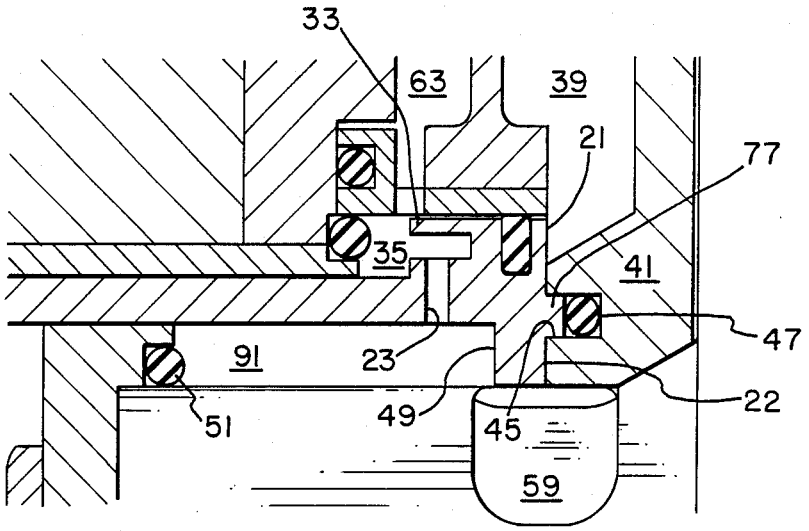
FIG. 1*a* is an enlarged view of a portion of the air control valve of FIG. 1.
Figure 6A:
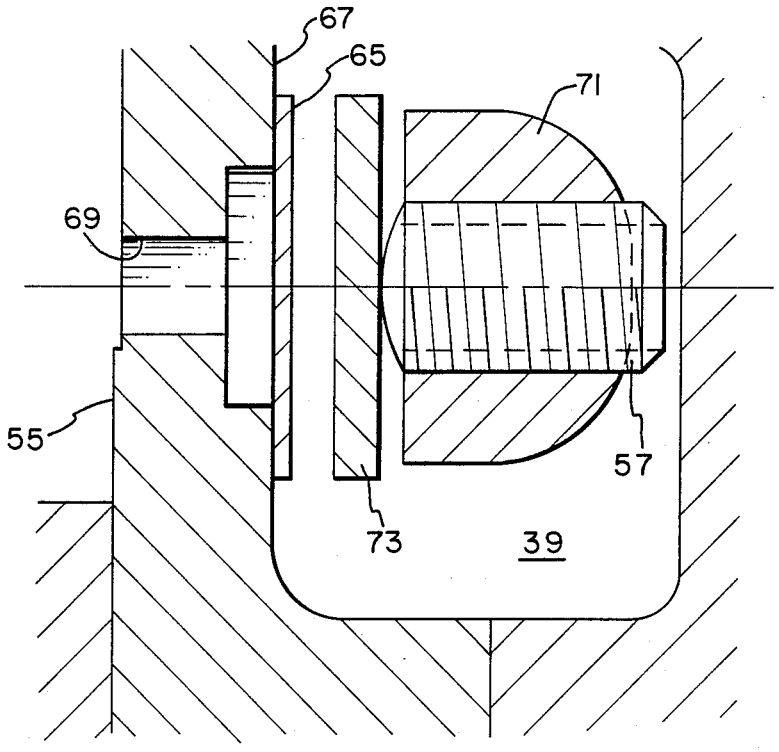
FIGS. 2–7 are views in cross-section similar to FIG. 1, but illustrating component motion and function as the piston progresses rightwardly to its extreme rightward or valve open position.

Comparing FIGS. 1 and 1*a*, it will be noted that port 23 is always open providing an air path between chambers 91 and 35, hence the two chambers increase in pressure together as the subpiston segment 29 moves toward the right applying the high control valve closing pressure equally to all the back surfaces insuring a more positive and rapid valve reclosure. Control valve reclosure is accomplished without the addition of any source air, however, in cases where the magnetic characteristics of the latching assembly are reduced, additional source air may be resorted to for aiding reclosure. Such additional or prepressurizing air may be obtained by a slight widening of the window 59 so that the tang or tab 77 clears the slot 45 before the edge 49 closes off communication between window 59 and chamber 91. The amount of such prepressurization may be controlled by source air pressure, speed of movement of the air control valve as well as window size and location.

Figure 2:
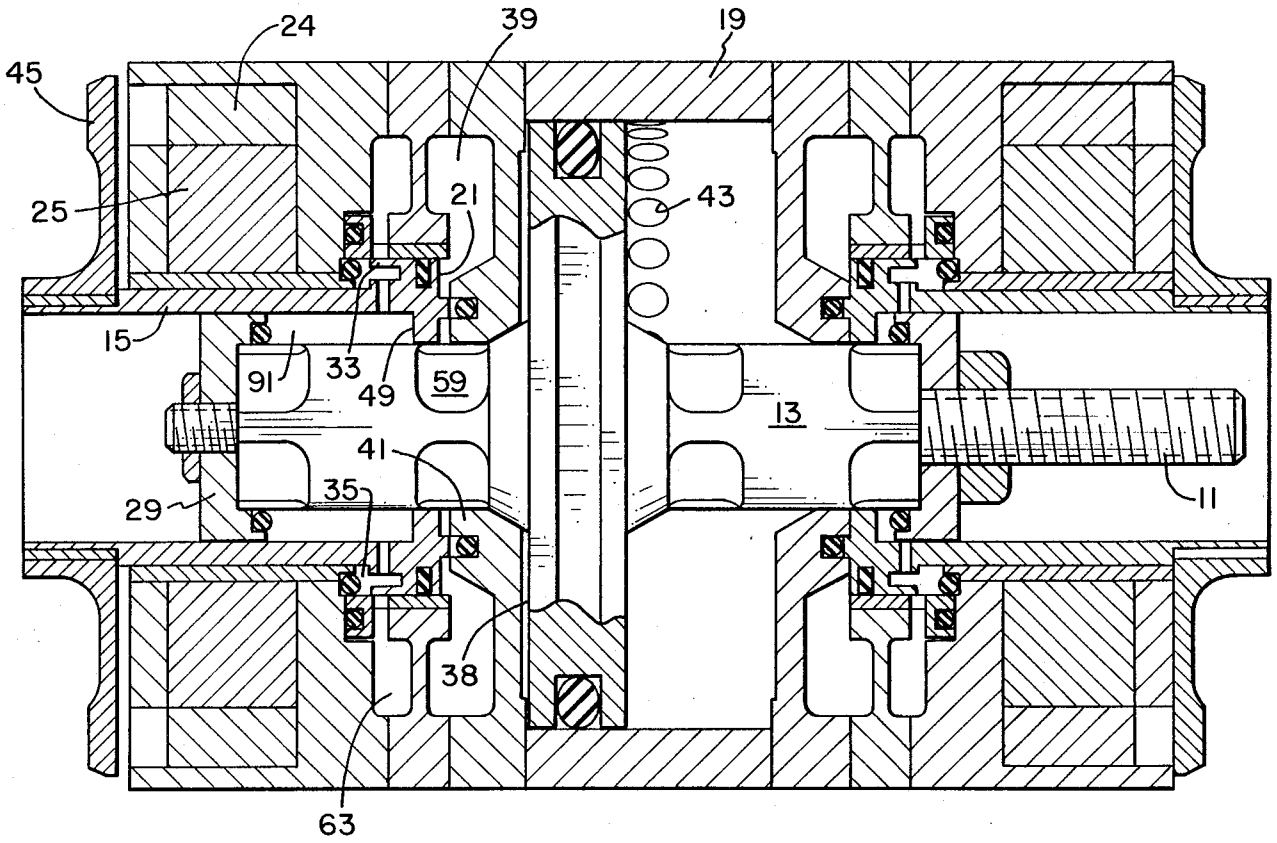
Figure 3:
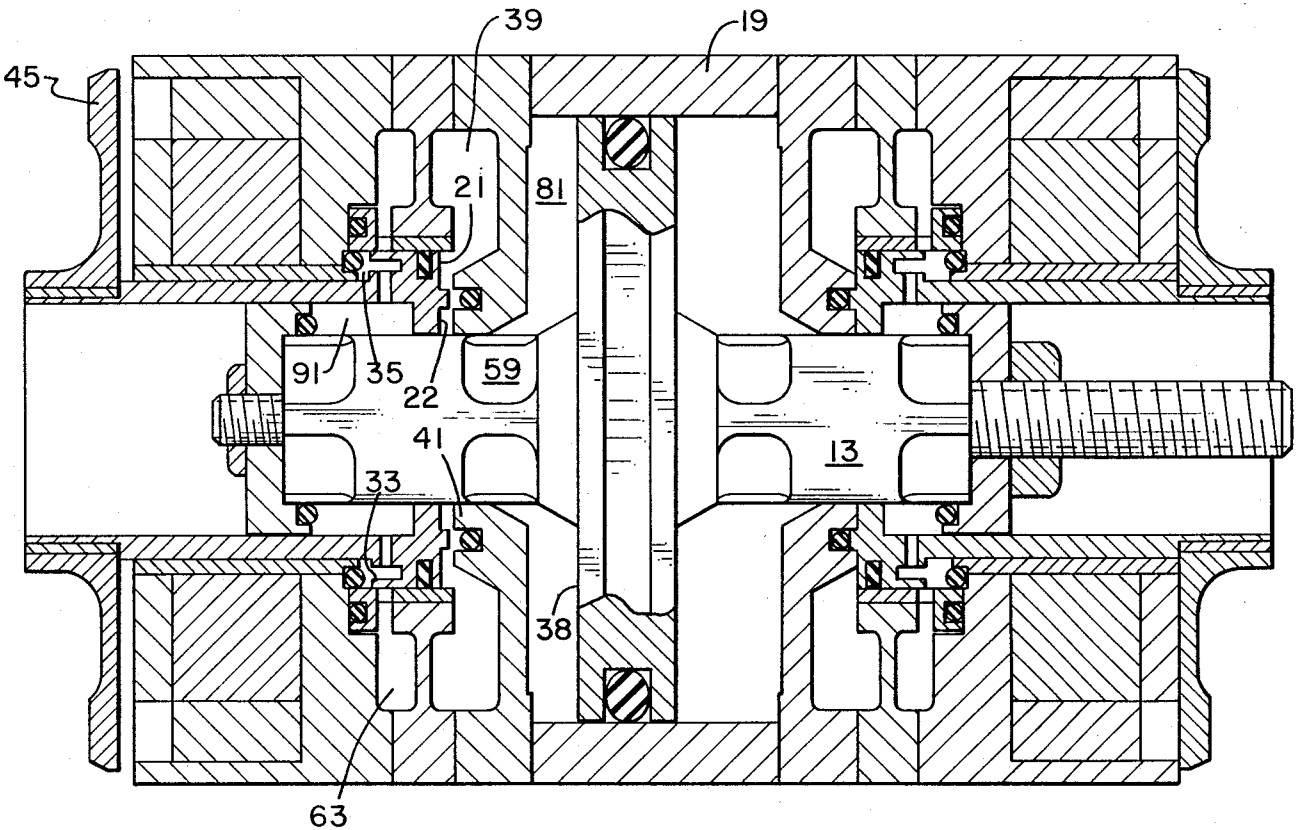

In FIG. 2, coil 24 has been energized neutralizing the holding force of permanent magnet 25 on armature 45 and the air control or shuttle valve 15 has moved toward the left, for example, 0.035 in. while piston 13 has not yet moved toward the right while FIG. 3 shows the opening of the air valve 15 to about 0.045 in. and movement of the piston 13 about 0.140 in. to the right. In FIG. 2, the high pressure air had been supplied to the cavity 39 and to the face 38 of piston 13 driving that piston toward the right. That high pressure air supply by way of cavity 39 to piston face 38 is cut off in FIG. 3 by the edge of the window 59 of piston 13 passing the annular abutment 41 of the housing 19. Piston 13 continues to accelerate, however, due to the expansion energy of the high pressure air in cavity 81. In FIG. 2 coil 24 is energized and the field from permanent magnet 25 is decreased until the air control valve 15 is free to move. Air valve 15 is accelerated from the high pressure in chamber 39 acting on control valve faces 21 and 22. Atmospheric port 63 no longer communicates with subpiston chamber 91 because annulus 33 has isolated the chamber 35 from the low pressure outlet port 63. The subpiston chamber 91 acts as a complex air spring being compressed and this increasing pressure is applied to face 49 of the air control valve 15 as well as within chamber 35. The motion of subpiston 29 and air valve 15 is towards each other, this makes up a nonlinear changing volume thus creating the complex air spring. The air valve 15 has traveled a little over one-half of its total travel in FIG. 2. As tang 77 slides clear of the body 41 portion of the main housing 19, main piston 13 is accelerated by the high pressure from chamber 39 through window 59. Window 59 and the other windows to be discussed subsequently are a series of shallow peripheral undercuts in an otherwise cylindrical portion of the main piston.

Returning to FIG. 1, if the (inappropriate) coil 26 is energized and the magnetic field of magnet 27 is neutralized sufficiently that the high air pressure on surface 75 begins to open air valve 17, windows such as 79 will assure that the valve 17 is immediately returned to its closed position. When the main piston is to the extreme left as in FIG. 1, edge 83 of window 79 is in alignment with edges 85 and 87. If the valve 17 is released from the right hand latch assembly through neutralization of the flux from magnet 27 thereby allowing the pneumatic force on face 89 of the valve to cause the air valve to move to the right then the high pressure air from cavity 39 passes through the opening between surfaces 85 and 87 and through the window 79 to cavity 95, thus in the main removing the pneumatic force causing the air valve to open. Slight dimensional changes will also allow this high pressure air to pass through aperture 23 and on to cavity 99 further neutralizing the pressure applied to the valve if desired. After the flux of the magnet 27 is no longer opposed, the magnetic attractive force on armature 101 overcomes the residual pneumatic force on the air valve closing it. Thus, an inadvertent excitation of the latch on the opposite end of the actuator from where the piston is presently located results in the control valve being rapidly returned shutting the valve without adverse effects such as locking in an open condition. Such a technique allows both latches to be excited together by a common source, thus cutting in half the required number of electronic driver circuits.

In FIG. 3 air valve 15 has traveled to its full open position. Air in subpiston chamber 91 continues to be compressed and a small amount of energy is being extracted from the main piston 13 by subpiston 29 due to the building pressure in subpiston chamber 91. Window 59 has cut off main piston 13 from the source pressure The main piston 13 has now traveled about thirty percent of its total travel and the high pressure in main piston cylinder 81 is being expanded.

Figure 4:
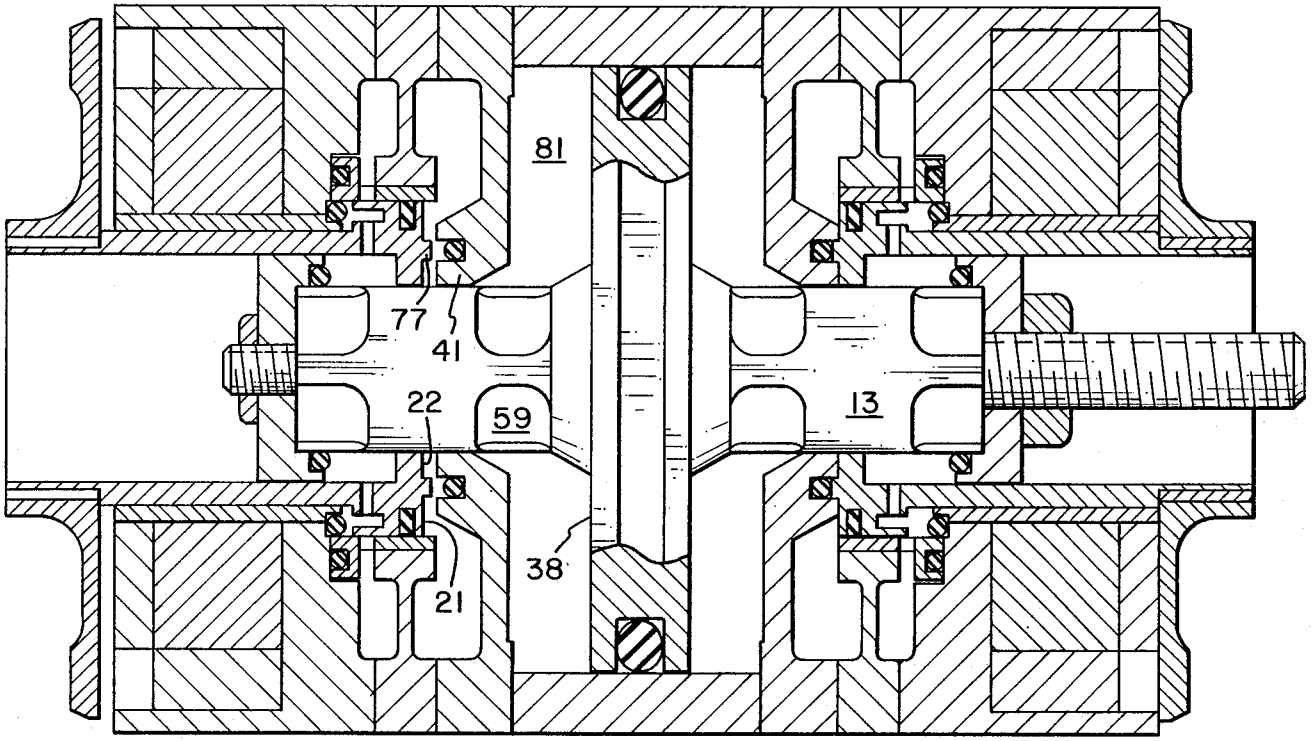

In FIG. 4 air valve 15 remains fully open and the atmospheric air in subpiston chamber 91 is being compressed to a higher value. More energy is being extracted from the main piston 13 by subpiston 29. The high pressure in main cylinder 81 is continuing to expand. The pressure on the right side of the main cylinder 81 is beginning to be compressed and dampening of main piston 13 has begun.

Figure 5:
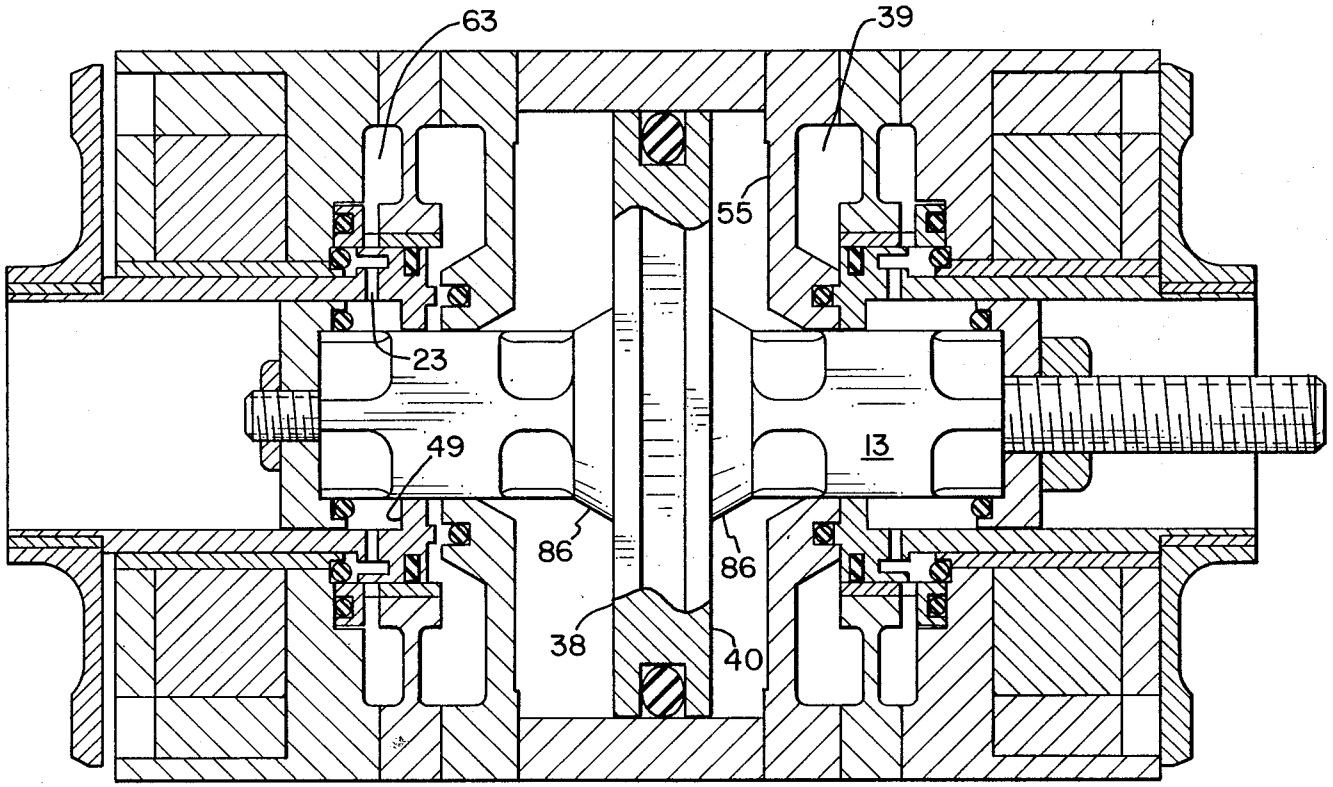

In FIG. 5 the pressure in subpiston chamber 91 is just beginning to overcome the source pressure in chamber 39 and beginning to cause air valve 15 to be accelerated back toward its closed position as in FIG. 1 Even more energy is being extracted from main piston 13 by subpiston 29. The pressure on the working surface 40 on the right side of main piston 13 continues to grow and dampen the actuator.

Figure 6:
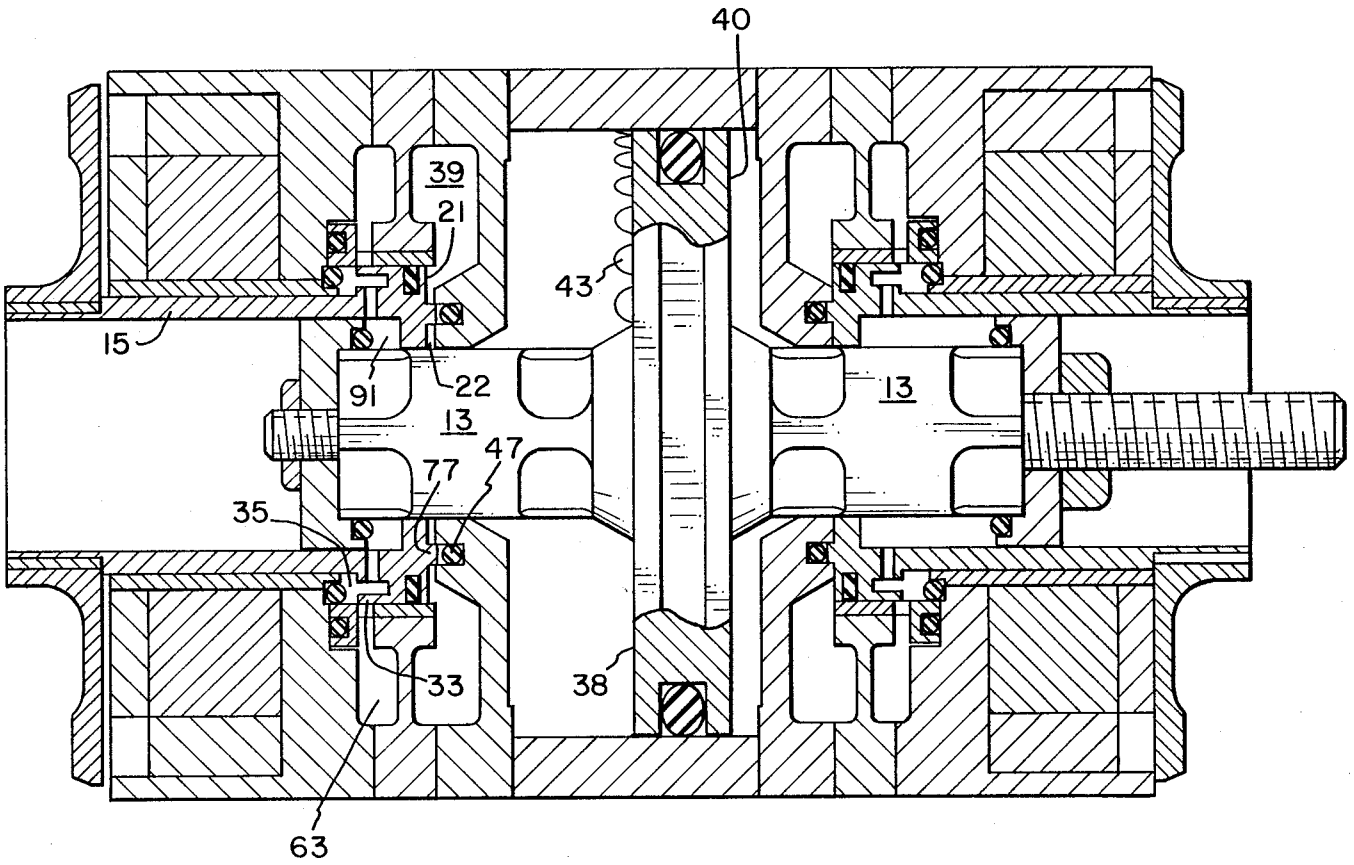

In FIG. 6 the pressure in subchamber 35 and subpiston chamber 91 has overpowered the source pressure in chamber 39 and air valve 15 is on its way back to its position of FIG. 1. The tang 77 has turned off the source pressure on the face 22 of air valve 15. The pressure on the left side 38 of main piston 13 is at the latching or intermediate pressure of source 43 and the pressure on the right side 40 of main piston 13 continues to grow and dampen the actuator. Edge 33 has cleared opening chamber 35 to vent subpiston chamber 91 to atmospheric or low pressure outlet 63.

When the pressure on the right side 40 of the main piston reaches source pressure in chamber 39, one or more reed valves open to vent this excess pressure back into the source. One reed valve which is shown in detail in FIG. *6a* and functions as a means for selectively controlling the quantity of trapped air which is returned to the high pressure source. As shown in FIG. *6a*, the reed valve is a one-way valve which is movable between closed and opened positions and includes an arrangement in the form of an adjustable set screw 57 for varying the distance between the closed and opened positions. The reed 65 has some resilience and normally rests on surface 67 so as to seal the port hole 69, but is forced away from the surface 67 by a sufficiently elevated pressure in the piston chamber to pass excess pressure air back into source chamber 39. The set screw 57 allows adjustment to allow greater or lesser amounts of air to pass through the reed valve thereby providing control over final damping of the piston. The set screw controls the separation between movable plate 73 and stationary block 71. The selected position of the movable plate controls the allowable opening of reed 65 and that, in turn, controls the quantity of excess pressure air which is vented from the piston chamber and, therefor, the degree of damping experienced by the piston. Thus, the one-way valve includes a reed which, when in the closed position, engages and covers an opening in the housing along with an adjustable stop for limiting the distance the reed moves away from the opening in the housing.

Figure 7:
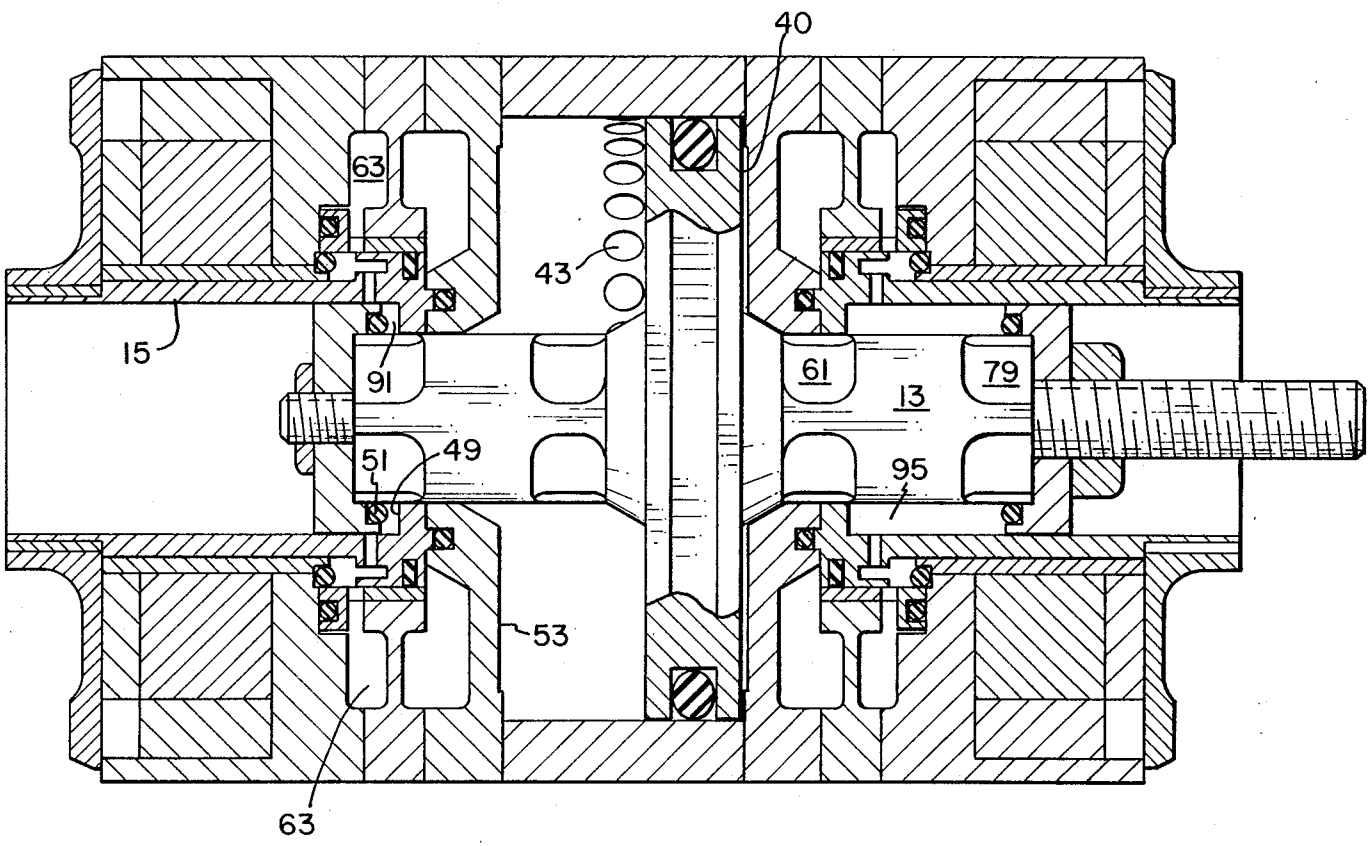

In FIG. 7 the air valve 15 has returned to its closed and latched position as in FIG. 1. The pressure in annular subchamber 91 has vented to the atmosphere through port 63. The main piston 13 in FIG. 7 has completed its travel and the piston damping pressure on the right side 40 of main piston has vented through window 61 into subpiston chamber 93 to port 80. One transition of the actuator is now complete and essentially the same process as above may be followed in the return transition. Should inadequate air pressure, inadequate magnetic field, or other problem result in the air control valve failing to close, the "0" ring resilient bumper 51 will impact surface 49 forcing the air control valve back to the closed position. This "bumper" is also effective to insure closure of the control valve during initial testing or calibration of the actuator.

A comparison of FIGS. 1 and 7 which illustrate the two stable states of the pneumatically powered valve actuator reveals the fact that the working cylinder within which the main piston reciprocates has a pair of opposed contoured end faces 53 and 55, and that the main piston 13 has a pair of oppositely facing primary working surfaces 38 and 40 which are contoured substantially the same as the opposed end faces of the working cylinder to mate therewith. The contoured end faces each include a central opening, an outer annular flat surface and an intermediate frustoconical surface 86 connecting the flat surfaces and the central opening. Such close mating of these surfaces results in a minimum volume which is very small helping to provide a high compression ratio for piston motion. The conical segment 86 improves strength at minimum mass, but more importantly, this conical segment 86 allows the axial length of the windows 59 and 61 to be short, thus of lower volume, and again improving the compression ratio of the device.

It will be understood from the symmetry of the valve actuator that the behavior of the air control valves 15 and 17 in utilizing main piston energy for additional valve reclosure force is, as are many of the other features, substantially the same near each of the opposite extremes of the piston travel.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.125 inches, therefor requiring less energy to operate. The air passageways in the present invention are generally large annular openings with little or no associated throttling losses.

From the foregoing, it is now apparent that a novel electronically controlled, pneumatically powered actuator has been disclosed meeting the objets and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A pneumatically powered valve actuator comprising a valve actuator housing; a piston reciprocable within the housing along an axis, the piston having a pair of oppositely facing primary working surfaces; a pressurized high pressure air source, an intermediate pressure air pressure source, and a Low pressure air outlet; a pair of air control valves reciprocable along said axis relative to both the housing and the piston between open and closed positions; means for selectively opening one of said air control valves to supply pressurized air from the air source to one of said primary working surfaces causing the piston to move; means operable subsequent to initial piston movement and responsive to continued piston motion for compressing a trapped volume of air thereby slowing piston movement; means for returning some of the trapped air which has been compressed to a pressure greater than the pressure of the high pressure source to the high pressure source; and means for selectively controlling the quantity of trapped air which is returned to the high pressure source.

2. The pneumatically powered valve actuator of claim 1 wherein the means for selectively controlling comprises at least one one-way valve movable between closed and opened positions and having means for varying the distance between the closed and opened positions.

3. The pneumatically powered valve actuator of claim 2 wherein the one-way valve includes a reed which, when in the closed position, engages and covers an opening in the housing, the means for varying including an adjustable stop for limiting the distance the reed moves awa from the opening in the housing.

4. A pneumatically powered valve actuator comprising a valve actuator housing; a main piston reciprocable within the housing along an axis: a pair of auxiliary pistons fixed to and movable with the main piston, the main piston having a pair of oppositely facing primary working surfaces; a pressurized air source; a low pressure in outlet; a pair of air control valves reciprocable along said axis relative to both the housing and the main piston between open and closed positions; means for selectively opening one of said air control valves to supply pressurized air from the air source to one of said primary working surfaces causing the main piston and the pair of auxiliary pistons to move; each auxiliary piston forming, in conjunction with a surface of the corresponding air control valve, a variable volume annular chamber; and means responsive to the motion of one of the auxiliary pistons for urging the one air control valve toward its closed position, the means responsive to motion including the variable volume annular chamber, the pressure within the variable volume annular chamber associated with said one air control valve being initially at atmospheric pressure and increasing throughout a portion of time during which the main piston moves and dropping back to atmospheric pressure when the air control valve returns to its closed position independent of the position of the main piston.

5. The pneumatically powered valve actuator of claim 4 further including means operable subsequent to initial piston movement and responsive to continued piston motion for compressing a trapped volume of air thereby slowing piston movement, means for returning some of the trapped air which has been compressed to a pressure greater than the pressure of the high pressure source to the high pressure source, and means for selectively controlling the quantity of trapped air which is returned to the high pressure source.

6. The pneumatically powered valve actuator of claim 5 wherein the means for selectively controlling comprises at least one one-way valve movable between closed and opened positions and having means for varying the distance between the closed and opened positions.

7. The pneumatically powered valve actuator of claim 6 wherein the one-way valve includes a reed which, when in the closed position, engages and covers an opening in the housing, the means for varying including an adjustable stop for limiting the distance the reed moves away from the opening in the housing.

8. The pneumatically powered valve actuator of claim 4 further comprising resilient means on each auxiliary piston for engaging and closing the corresponding air control valve if the pressure in the variable volume chamber is inadequate to close the air control valve.

9. The pneumatically powered valve actuator of claim 4 wherein the housing includes a working cylinder having a pair of opposed contoured end faces; the main piston being reciprocable within the cylinder along an axis and having a pair of oppositely facing primary working surfaces contoured substantially the same as the opposed end faces of the working cylinder to mate therewith.

10. The pneumatically powered valve actuator of claim 9 wherein the contoured end faces each include a central opening, an outer annular flat surface, and an intermediate frustoconical surface connecting the flat surfaces and the central opening.

11. A pneumatically powered valve actuator comprising a valve actuator housing; a main piston reciprocable within the housing along an axis; a pair of auxiliary pistons fixed to and movable with the main piston, the main piston having a pair of oppositely facing primary working surfaces; a pressurized air source; a low pressure air outlet; a pair of air control valves reciprocable along said axis relative to both the housing and the main piston between open and closed positions; means for selectively opening one of said air control valves to supply pressurized air from the air source to one of said primary working surfaces causing the main piston and the pair of auxiliary pistons to move; each auxiliary piston forming, in conjunction with a surface of the corresponding air control valve, a variable volume annular chamber; and means responsive to the motion of one of the auxiliary pistons for urging the one air control valve toward its closed position, the means responsive to motion including the variable volume annular chamber and resilient means on each auxiliary piston for engaging and closing the corresponding air control valve if the pressure in the variable volume chamber is inadequate to close the air control valve.

12. A pneumatically powered valve actuator comprising a valve actuator housing; a working cylinder having a pair of opposed contoured end faces; a main piston reciprocable within the cylinder along an axis, the main piston having a pair of oppositely facing primary working surfaces contoured substantially the same as the opposed end faces of the working cylinder to mate therewith; a pair of air control valves reciprocable along said axis relative to both the housing and the main piston between open and closed positions; a high pressure air source; means for selectively opening one of said air control valves to supply pressurized air from the high pressure air source to one of said primary working surfaces causing the main piston to move.

13. The pneumatically powered valve actuator of claim 12 wherein the contoured end faces each include a central opening, an outer annular flat surface, and an intermediate frustoconical surface connecting the flat surfaces and the central opening.

14. A bistable electro-pneumatic transducer comprising a housing; a main piston reciprocable within the housing along an axis, the main piston having a pair of oppositely facing primary working surfaces; a pair of air control valves reciprocable along said axis relative to both the housing and the main piston between open and closed positions; a high pressure air source located closely adjacent each of the air control valves; means for selectively opening one of said air control valves to supply pressurized air from the high pressure air source to one of said primary working surfaces causing the main piston to move; a pair of auxiliary pistons fixed to and movable with the main piston, each auxiliary piston forming, in conjunction with a surface of the corresponding air control valve, a variable volume annular chamber; means responsive to the motion of one of the auxiliary pistons for urging the one air control valve toward its closed position; and means cooperating with the variable volume chamber, when its volume is at a minimum, for providing a path for applying high pressure air pressure to urge the control valve toward a closed position to thereby preclude inappropriate opening of the associated air control valve.

15. The bistable electro-pneumatic transducer of claim 14 wherein the means responsive to motion includes the variable volume annular chamber, the pressure within the variable volume annular chamber associated with said one air control valve being initially at atmospheric pressure and increasing throughout a portion of time during which the main piston moves and dropping back to atmospheric pressure before the main piston stops.

16. The bistable electro-pneumatic transducer of claim 14 further comprising resilient means on each auxiliary piston for engaging and closing the corresponding air control valve if the pressure in the variable volume chamber is inadequate to close the air control valve.

* * * * *